US012790108B1

(12) United States Patent
Thornton

(10) Patent No.: US 12,790,108 B1
(45) Date of Patent: Nov. 10, 2026

(54) METHOD AND SYSTEM BULK TRANSPORT OF AGRICULTURAL PRODUCTS

(71) Applicant: Winfred Thornton, St. Augustine, FL (US)

(72) Inventor: Winfred Thornton, St. Augustine, FL (US)

( * ) Notice: Subject to any disclaimer, the term of this patent is extended or adjusted under 35 U.S.C. 154(b) by 3 days.

(21) Appl. No.: 19/343,430

(22) Filed: Sep. 29, 2025

(51) Int. Cl.
*B65D 88/12* (2006.01)
*B65D 90/04* (2006.01)
*B65D 90/38* (2006.01)

(52) U.S. Cl.
CPC ..... *B65D 88/121* (2013.01); *B65D 90/04* (2013.01); *B65D 90/38* (2013.01); *B65D 2590/023* (2013.01); *B65D 2590/542* (2013.01)

(58) Field of Classification Search
CPC ..... B65D 88/121; B65D 88/56; B65D 90/04; B65D 90/38; B65D 2590/023; B65D 2590/542
See application file for complete search history.

(56) References Cited

U.S. PATENT DOCUMENTS 3,966,075 A * 6/1976 Schultz ..... B65D 88/025 220/8
4,212,405 A * 7/1980 Schmidt ..... B62D 29/008 296/182.1
5,050,897 A * 9/1991 Stromberg ..... B62D 53/067 280/43
5,911,337 A * 6/1999 Bedeker ..... B65D 90/028 220/562
9,701,466 B1 * 7/2017 Horton ..... B65D 88/56
10,351,043 B1 * 7/2019 Kibler ..... B60P 1/56
10,464,741 B2 * 11/2019 Oren ..... B65D 90/20
10,787,312 B2 * 9/2020 Oren ..... B65D 88/30
11,377,012 B2 * 7/2022 Herman ..... B60P 3/2245
12,522,428 B2 * 1/2026 Hunter ..... B65D 88/56
2005/0260062 A1 * 11/2005 Boasso ..... B60P 1/00 414/332
2007/0151971 A1 * 7/2007 Petzitillo, Jr. ..... B65D 88/127 220/1.5
2012/0114821 A1 * 5/2012 Schrader ..... B65D 88/745 206/524.1
2012/0276262 A1 * 11/2012 Schrader ..... B65D 88/54 426/389
2018/0086245 A1 * 3/2018 Heck ..... B65D 88/56
2019/0255982 A1 * 8/2019 O'Neill ..... B60P 7/132
2019/0308805 A1 * 10/2019 Nasich ..... B65D 88/56
2020/0095058 A1 * 3/2020 O'Neill ..... B66F 9/0655
2021/0130085 A1 * 5/2021 Shepherd ..... B65D 88/30
(Continued)

*Primary Examiner* — Saul Rodriguez
*Assistant Examiner* — Ashley K Romano
(74) *Attorney, Agent, or Firm* — McHale & Slavin, P.A.

(57) ABSTRACT

A method is provided for transporting agricultural products from a farm to a processing facility using containers. Products are loaded into the containers at the farm, transferred by truck and rail to a processing plant. The containers are offloaded, trucked to the plant, and emptied using a rotate-to-dump station. A modular container system for transporting raw sugar or agricultural includes products an approximately 8'×8'×12' container with sealed access doors to protect contents from moisture and contamination. Corner couplings engage truck bogies, truck beds, rail cars, and handling gear for intermodal transport. Inner walls are coated to reduce adherence and ease cleaning.

7 Claims, 9 Drawing Sheets

(56) References Cited

U.S. PATENT DOCUMENTS

| | | | | |
|---|---|---|---|---|
| 2021/0130113 | A1* | 5/2021 | Shepherd | B65G 65/005 |
| 2023/0348212 | A1* | 11/2023 | Bosich | B65G 67/50 |
| 2024/0417163 | A1* | 12/2024 | Binetti | B65D 88/56 |
| 2025/0058964 | A1* | 2/2025 | Hunter | E21B 41/00 |
| 2025/0100791 | A1* | 3/2025 | Ximenes | B65D 88/66 |
| 2025/0282552 | A1* | 9/2025 | Stoddard | B65G 65/23 |

* cited by examiner

METHOD AND SYSTEM BULK TRANSPORT OF AGRICULTURAL PRODUCTS

FIELD OF THE INVENTION

The invention is directed to the field of agricultural product transportation and in particular to an improved method and container system for transporting agricultural products by truck and train.

BACKGROUND OF THE INVENTION

Bulk transport by truck and rail car is a major mode of transportation for bulk agricultural commodities. The types of agricultural products commonly shipped by rail car include: Sugar, Corn, Wheat, Soybeans, Oats and the like. One of the most difficult commodities to transport is raw sugar due to different grades and sugar becoming sticky under certain conditions. For purposes of this application, the transportation of raw sugar will be used as the primary embodiment as the ability to transport raw sugar being the commodity most difficult to transport.

Sugarcane is a tropical and subtropical crop that requires warm temperatures (above 20° C. or 68° F.), high humidity, and plenty of water for optimal growth. It is sensitive to frost and does not tolerate extreme cold or drought conditions well. In the United States, a large percentage of sugarcane is grown in the southern part of Florida, particularly around the lower end of Lake Okeechobee, namely, the Belle Glade area. Essentially the land would otherwise be considered everglades which seldom sees frost, extreme cold or drought conditions. This area, professionally recognized as the Everglades Agricultural Area (EAA), has a growing season from late October to early April wherein the sugarcane is harvested.

Harvesting of sugarcane is performed by burning the sugarcane field to remove excess leaves and tops making the harvesting process more efficient. Actual harvesting is almost exclusively performed by mechanical machines that cut the cane close to the ground, strip the leaves and tops of the plant, and chops the remaining stalks into smaller pieces (billets). The harvested cane is loaded onto large trailers and transported to sugar processing mills. Once the harvested sugarcane is at a mill, the cane is crushed to extract juice and processed into raw sugar according to three grades: 98% pure being the highest quality, 97% pure being an intermediate quality, and 96% pure being the lowest quality. Raw sugar, which is unrefined and has a light brown color, is ready to be transported to refineries.

Refining is a finishing process that includes the steps of melting raw sugar with hot water to dissolve it into a liquid syrup, filtering out impurities, removing residual color, concentrating, crystallization, drying and packaging. Refined sugar being granulated sugar-white sugar for general table use; powdered sugar-finely ground sugar mixed with a small amount of anti-caking agent; and brown sugar-refined sugar with molasses added back for flavor and color.

Refineries require the raw sugar; raw sugar is slightly sticky due to the thin layer of molasses that coats the sugar crystals and gives it a natural brown color. Molasses is a viscous by-product of the sugar refining process. The molasses coating on raw sugar tends to absorb and retain some moisture from the environment, contributing to its sticky texture. Stickiness is a common characteristic of raw sugar whereas refined sugar is white, dry, and granular.

The current method of transportation, and to which this invention addresses, can be made much more efficient. Of particular interest, are the five processing mills around Belle Glade, three of which have direct rail connections. Trucks are used to transport the raw sugar processed in the Belle Glade area to a warehouse in the Port of Palm Beach where it is held in silos according to the purity grades. When a cargo ship is available, the holds of the cargo ship are divided to hold the various purity grades. At the port, raw sugar is typically unloaded from the storage silos or warehouses and conveyed into the cargo ship's holds. This is often done using conveyor belts, pneumatic pipelines, or mechanical grabs. Raw sugar is loaded into the holds in a loose, unpackaged form, typically covered with tarps or plastic sheets to protect it from the elements. During the voyage, the cargo ship's holds are ventilated to prevent moisture buildup and to ensure the raw sugar remains dry and does not clump together. Raw sugar is hygroscopic wherein controlling humidity during shipping is important to avoid clumping or degradation. The holds are often designed with features that help maintain airflow, especially for sensitive commodities like sugar. Upon reaching the destination port, various systems like ship unloaders, conveyors, or vacuum systems are used to offload the raw sugar. Mechanical unloaders may use grabs or buckets to scoop the sugar from the hold and transfer it to storage. Processing about 650 tons of raw sugar a year from the Belle Glade area, 500K tons of the raw sugar is shipped by cargo ships to a refinery in Savannah Georgia, the other 150K tons of processed raw sugar is shipped by cargo ships to Baltimore, Maryland and Brooklyn, New York. Movement of raw sugar by freight train would appear to be a natural way of transporting unrefined sugar, but due to the raw sugar stickiness using conventional train equipment such as hoppers leads to clogging, (material forming an arch and not flowing), or rat-holing (material forming a channel and leaving stagnant areas). Bridging sticky raw sugar can clump together forming bridges that block flow.

What is needed in the industry is a more efficient and cost-effective method and apparatus to ship raw sugar from Belle Glade Florida to the northeast utilizing the CSX Rail which three of the five producers in Belle Glade have direct connections with.

SUMMARY OF THE INVENTION

The present invention relates to a transport container designed for intermodal use, particularly in highway and railroad applications. The container is a generally rectangular, box-shaped enclosure having dimensions of approximately eight feet wide, eight feet high, and twelve feet long. These dimensions are selected to optimize cargo capacity while maintaining compliance with applicable highway and railroad clearance requirements.

The container includes a structural metal body with front, rear, top, bottom, and side walls. Corner lifting fixtures are positioned at each of the four upper corners, conforming to ISO 1161 specifications, to enable secure lifting, stacking, and handling with standard container equipment. Reinforcing ribs or corrugations may be incorporated into the exterior walls to increase structural rigidity under load.

The top wall of the container incorporates two water-tight access doors, each pivotally secured by hinge assemblies. These doors are equipped with sealing gaskets and locking latches to maintain water-tight closure during transport, while permitting bulk commodities to be loaded through the top openings.

The interior of the container is preferably coated with a material such as high-density polyethylene (HDPE) lining to provide abrasion resistance, moisture protection, and chemical durability, while facilitating ease of cleaning.

The rear wall of the container includes a water-tight discharge door hinged along its top edge. The door swings outward into an open position to create a large unloading aperture, which permits gravity discharge of bulk materials as well as convenient cleaning of the container interior. Sealing gaskets and locking latches are provided to maintain a secure, water-tight seal during transport.

The design of the container ensures compatibility with international intermodal handling and securing practices, with corner fittings and securing mechanisms conforming to ISO 1161 and handling procedures in accordance with ISO 3874:2017. The invention thereby provides a durable, efficient, and interoperable solution for transporting bulk materials by highway, rail, or other intermodal methods.

An objective of the invention is to provide a container and system that improves efficiency, reduces costs, enhances material handling, and ensures regulatory compliance for the transportation of raw sugar using trucks and trains. The container allows seamless transfer between a truck and a train, optimizing logistics and reducing handling steps.

Another objective of the invention is to provide a container with dimensions that conform to highway and rail size regulations, ensuring safe and legal transport.

Still another objective of the invention is the elimination of intermediate storage such as silos or separate storage facilities by allowing raw sugar to remain within the container from loading to refinery input.

Still another objective of the invention is to provide a modular design that maximizes transport efficiency, allowing four containers for a conventional rail car, with a filling port and dumping wall to ensure easy filling and efficient discharge of raw sugar. The container system can be easily scaled and adapted to different grades of raw sugar, improving logistical flexibility.

Other objectives and further advantages and benefits associated with this invention will be apparent to those skilled in the art from the description, examples and claims which follow.

DESCRIPTION OF THE PREFERRED EMBODIMENT

Figure 1:
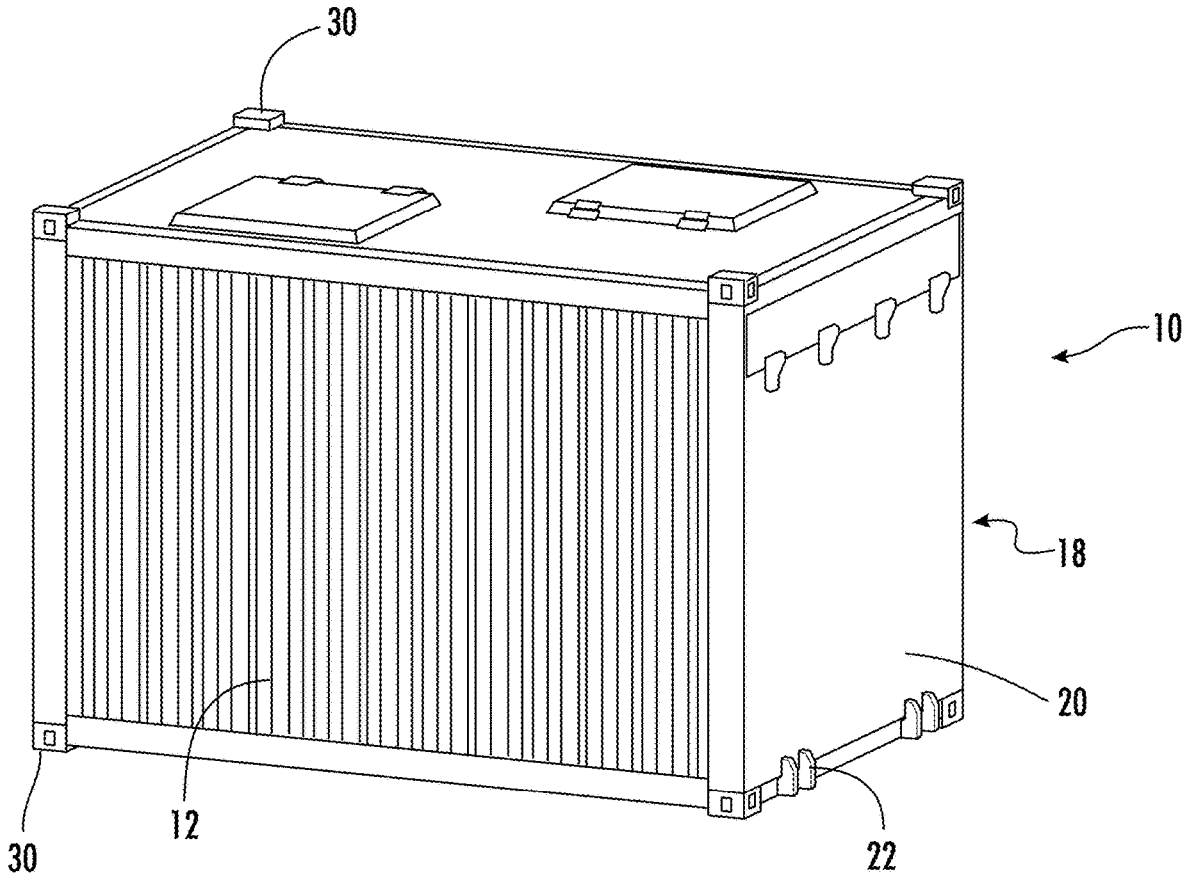
FIG. 1 is a perspective view of the container for the instant invention.
Figure 2:
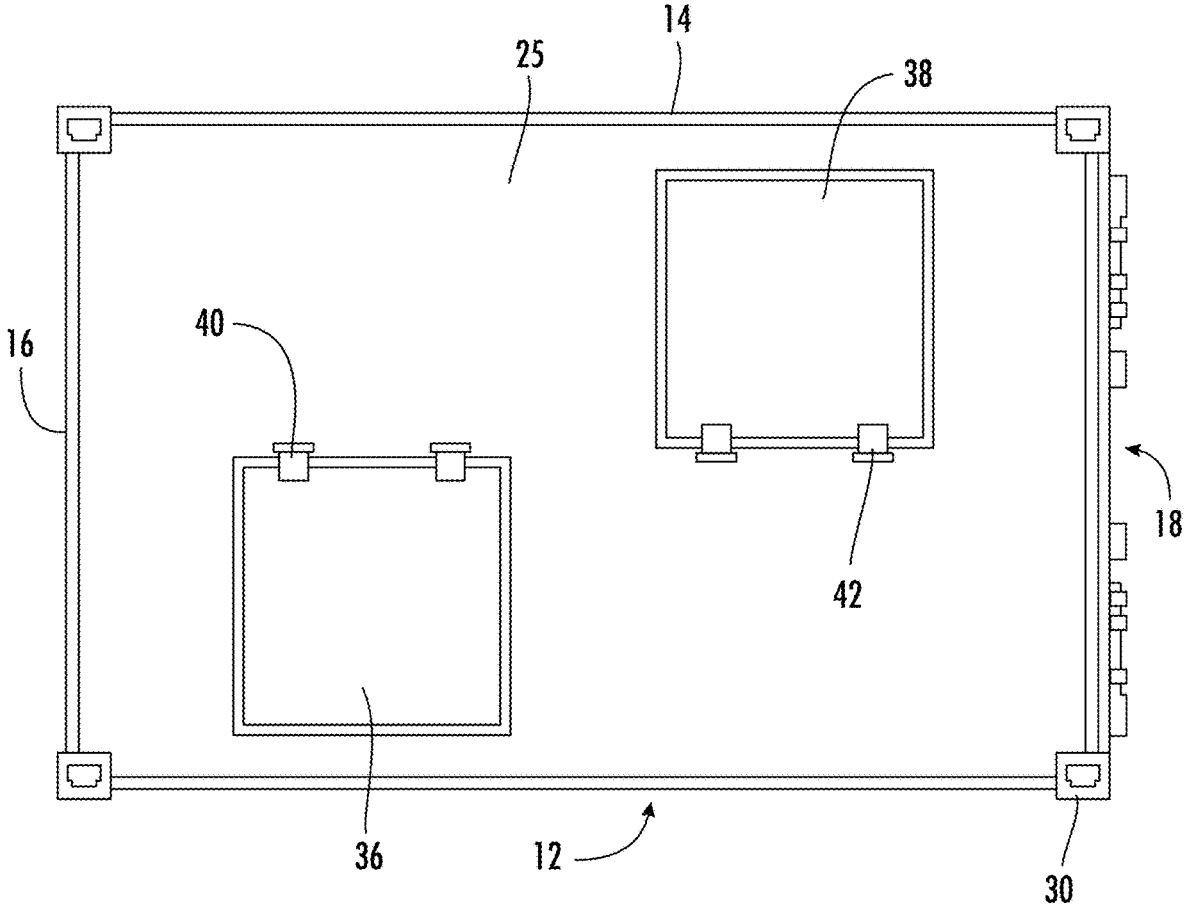
FIG. 2 is a top view thereof.
Figure 3:
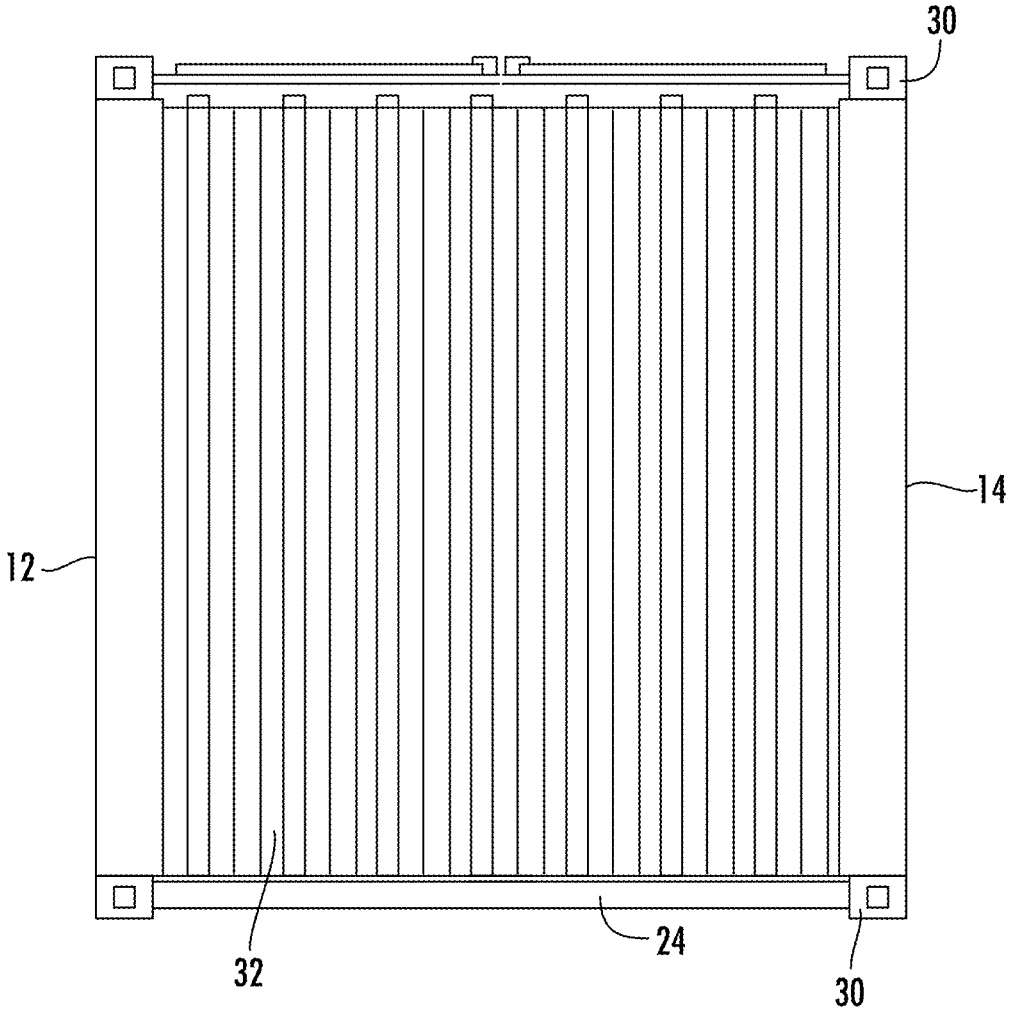
FIG. 3 is a front view thereof.
Figure 4:
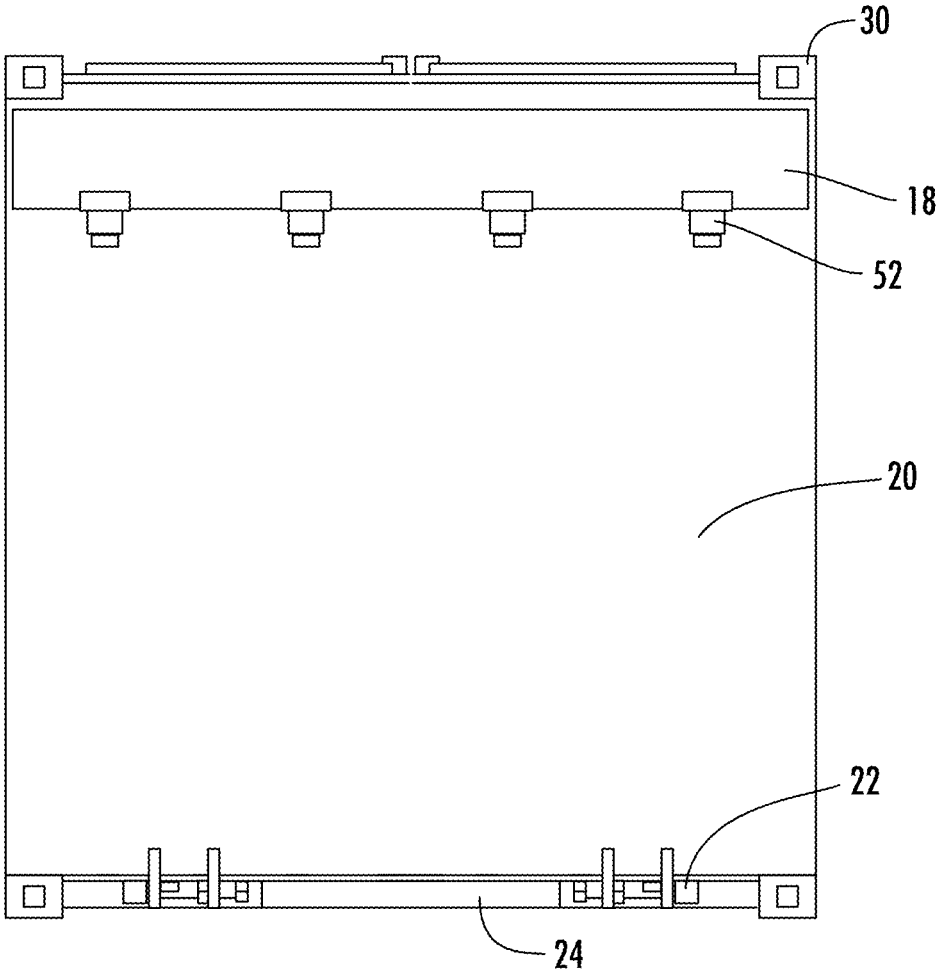
FIG. 4 is a rear view thereof.
Figure 5:
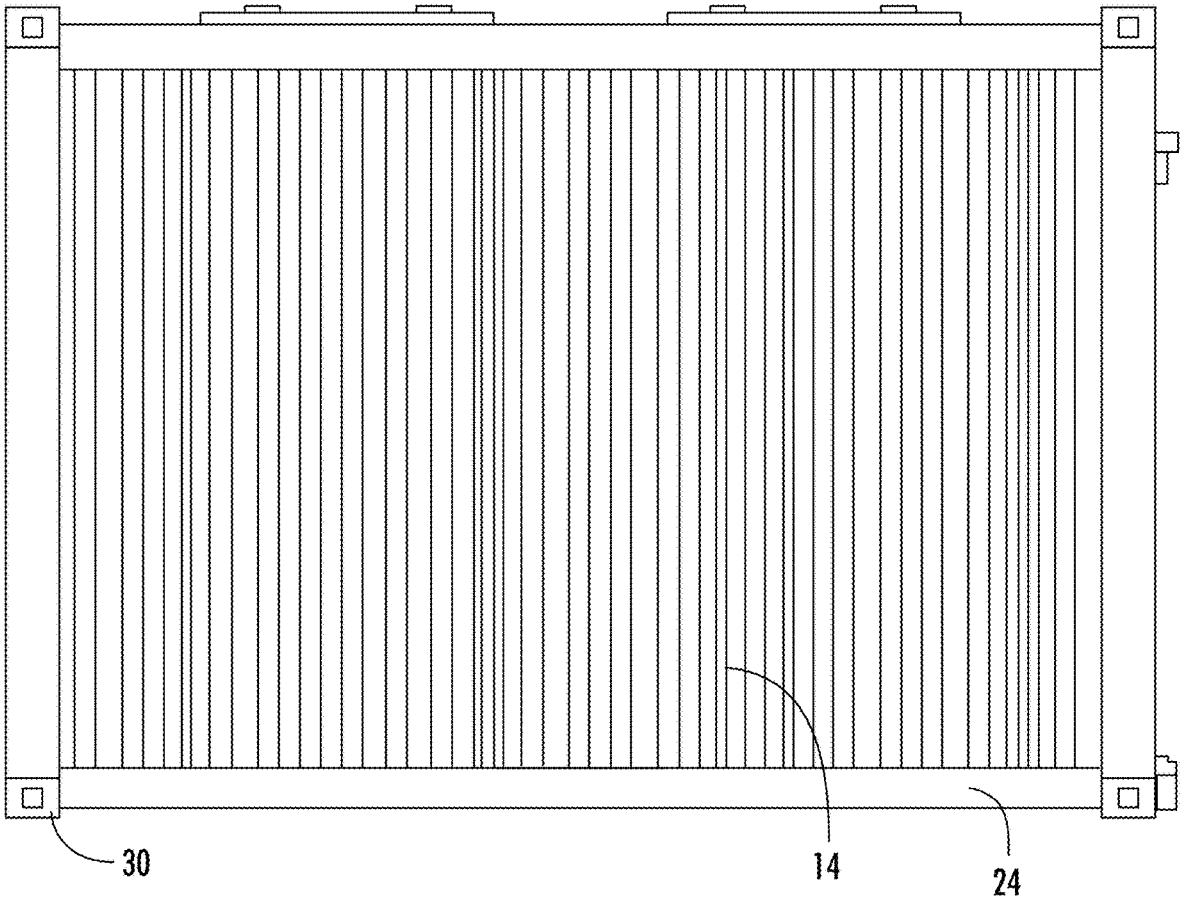
FIG. 5 is a side view with the opposite side forming a mirror image, not shown.
Figure 6:
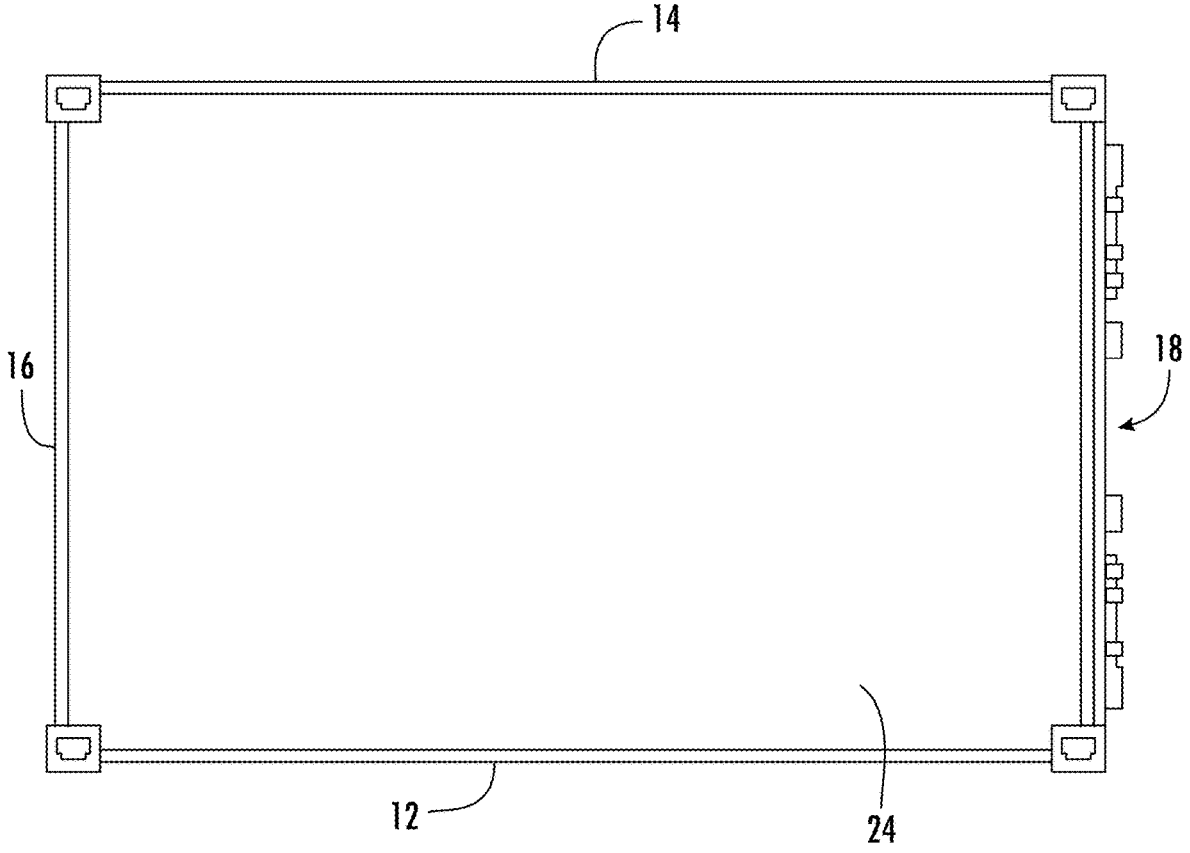
FIG. 6 is a bottom view thereof.
Figure 7:
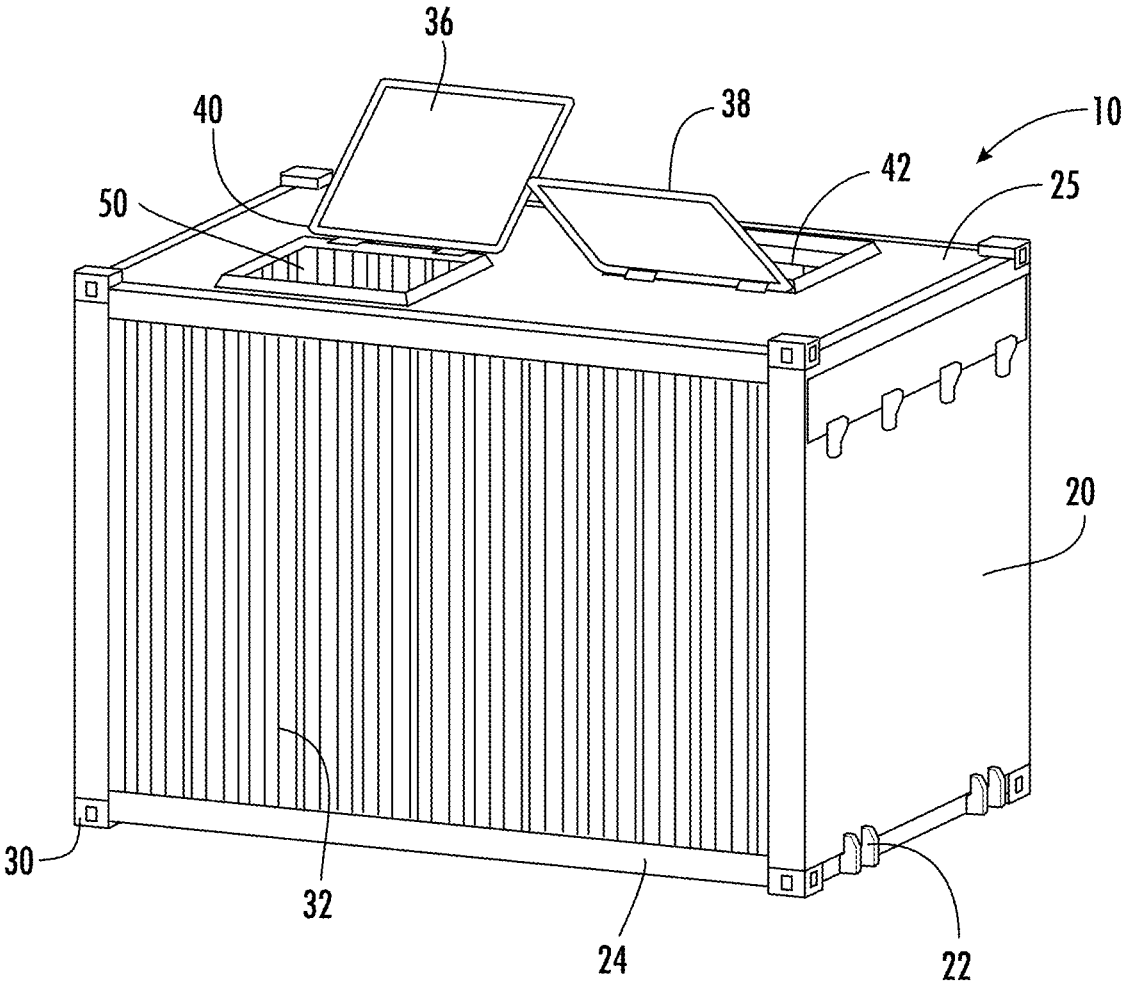
FIG. 7 is FIG. 1 with the top access doors open.

An embodiment of the instant invention is disclosed herein, however, it is to be understood that the disclosed embodiments are merely exemplary of the invention, which may be embodied in various forms. Therefore, specific functional and structural details disclosed herein are not to be interpreted as limiting, but merely as a basis for the claims and as a representation basis for teaching one skilled in the art to variously employ the present invention in virtually any appropriately detailed structure.

Disclosed is a modularized system to receive, protect and deliver raw sugar or other agricultural products from a farm to a processing facility. A modular container approximately 8'×8'×12' is the core component that receives and secures the raw sugar or farm products. The container will be equipped with internal coatings or appurtenance as needed for the cargo. Preferably the container is lined with a smooth, non-stick materials like HDPE (High-Density Polyethylene). Once loaded the container openings are secured with sealed door(s) that will protect contents from moisture and contamination. The containers are configured with a simple rotate to dump offloading sequence. The modular container is configured to use traditional truck bogies, rail cars and container handing gear (lift and securing castings on the container corners) with minimal modification. It is envisioned that sufficient scale/volume is present in seasonal transport that unit trains can be used for efficient round-trip deployment. This configuration enables the following process to be used to efficiently transport the raw sugar or agricultural products without contamination from the farm to the processing facility.

To enable the process, an apparatus and a method to receive, protect and deliver raw sugar and/or agricultural products from a farm to a processing facility is disclosed. The apparatus is based upon containers constructed and arranged to be coupled to a truck bed, truck bogie, or a rail car. For instance, a rail car can accept four containers. Each container is equipped with internal coatings, preferably a food grade non-stick polymer coating ideal for raw sugar to inhibit raw sugar from sticking to the walls, and allow for ease of cleaning using pressurized water. Other farm products may use coating suitable for the commodity.

Once loaded the container openings are secured with sealed access doors to protect the container contents from moisture and contamination. The modular container is configured to use traditional truck bogies, rail cars and container handing gear (lift and securing castings on the container corners) with minimal modification. In a preferred embodiment, sufficient scale/volume is present in seasonal transport that unit trains can be used for efficient round-trip deployment.

The raw sugar transport container dimensions are 8 feet wide, 8 feet high, and 12 feet long forming about 770 cubic feet of capacity. With raw sugar at about 40 lb/ft$^3$ or about 15 tons. The container weight and clearance meets all highway and railroad requirements. These containers can be picked up by the standard fixtures at its four upper corners, similar to those found on all interstate and international containers. The trailers and railcars can be purchased on the open market.

Referring to FIGS. 1-7 the container (10) is a generally rectangular, box-shaped enclosure having dimensions of approximately 8 feet wide, 8 feet high, and 12 feet long. These dimensions are selected to maximize transport efficiency while remaining compliant with and highway railroad clearance regulations. The container has a front wall (16), a rear wall (18), including a door (20) that is hinged (52) to the rear wall (18). The container has two sides (12) and top (14) along with a bottom (24) and top (25). The container is preferably fabricated from structural-grade steel (32) or other high-strength metals suitable for repeated handling and transport.

Corner lifting fixtures (30) are positioned at each of the four upper corners of the container (10), a standardized intermodal lifting fixture is provided. These lifting fixtures are structurally reinforced fittings with apertures and recesses compatible with spreader lifting frames, cranes, and other hoisting equipment commonly employed in interstate and international container transport. The fixtures (30) enable secure lifting, stacking, and positioning of the container without compromising the container walls. Reinforcing ribs or corrugations may be incorporated into the exterior panels to improve structural rigidity and resistance to deformation under load.

The top wall (25) incorporates two water-tight access doors (36) and (38). Each door is secured to the top wall (25) by a hinge assembly (40) and (42), permitting upward pivoting to open. The doors are equipped with sealing gaskets to ensure a water-tight closure, preventing ingress of rainwater or contaminants during transit. Locking latches are provided along the free edges of the doors to secure them in the closed position. These top doors facilitate loading of bulk materials into the container.

The inner walls of the container (10) are preferably coated with a high-density polyethylene (HDPE) lining (50). This lining (18) provides resistance to abrasion, moisture penetration, and chemical degradation, thereby protecting the container contents and improving cleanability. The lining may be applied as sheets, panels, or a sprayed-on polymer layer adhered to the metal substrate.

The rear wall (18) of the container (10) includes a water-tight discharge door (20) hinged (52) along its top. The hinge configuration permits the door (20) to swing outward to an open position, thereby creating a large unloading aperture. The open position further allows each of cleaning when the commodity is removed. A compressible sealing gasket is provided around the perimeter of the discharge door to ensure a water-tight seal when closed. The door (20) is further secured by locking latches (22), which maintain the door in a sealed condition during transport. This rear door design facilitates controlled unloading of container contents, particularly bulk commodities.

The container (10) is dimensioned and fitted to meet existing highway and railroad clearance requirements. The lifting and coupling fixtures (30) conform to the ISO 1161 standard for corner fittings, ensuring interoperability with existing container handling infrastructure. ISO 3874:2017 provides the methods for handling containers by rail and road, namely lifting, stowage, and securing practices.

Figure 8:
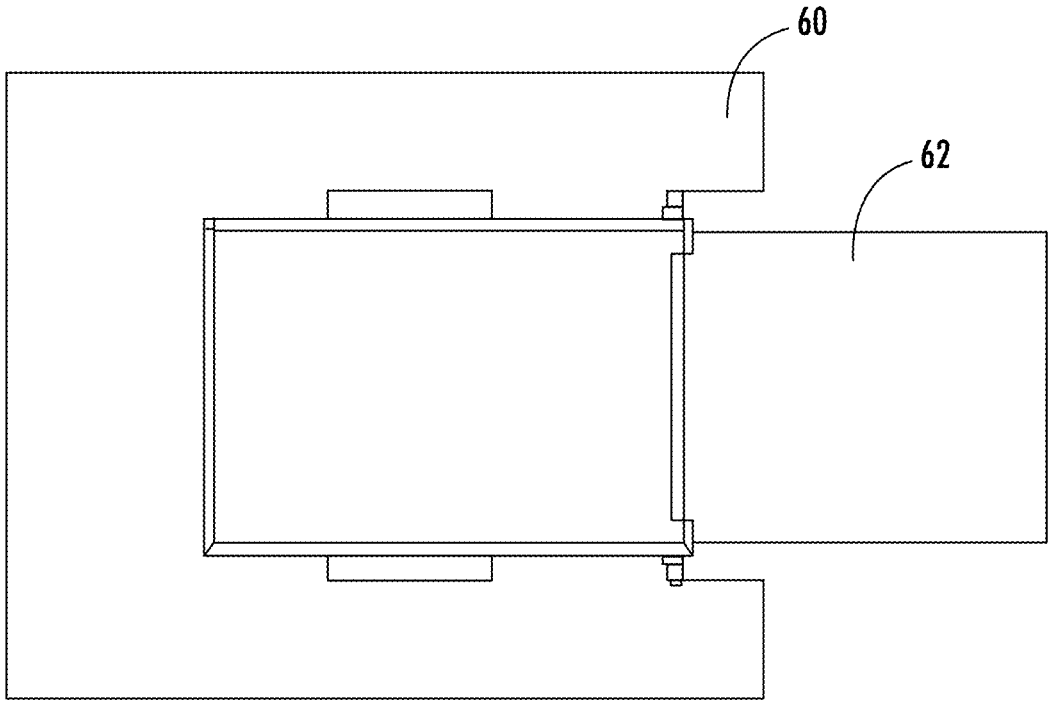
FIG. 8 illustrates a top view of the container platform.
Figure 9:
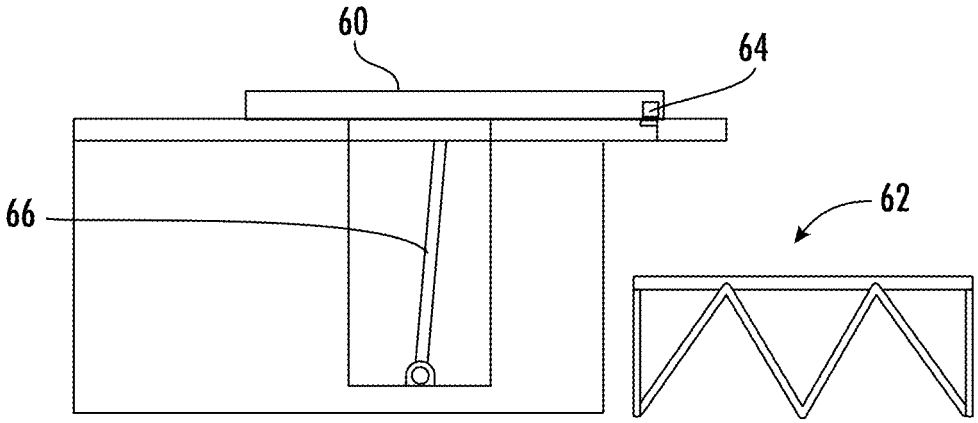
FIG. 9 is a side view thereof.
Figure 10:
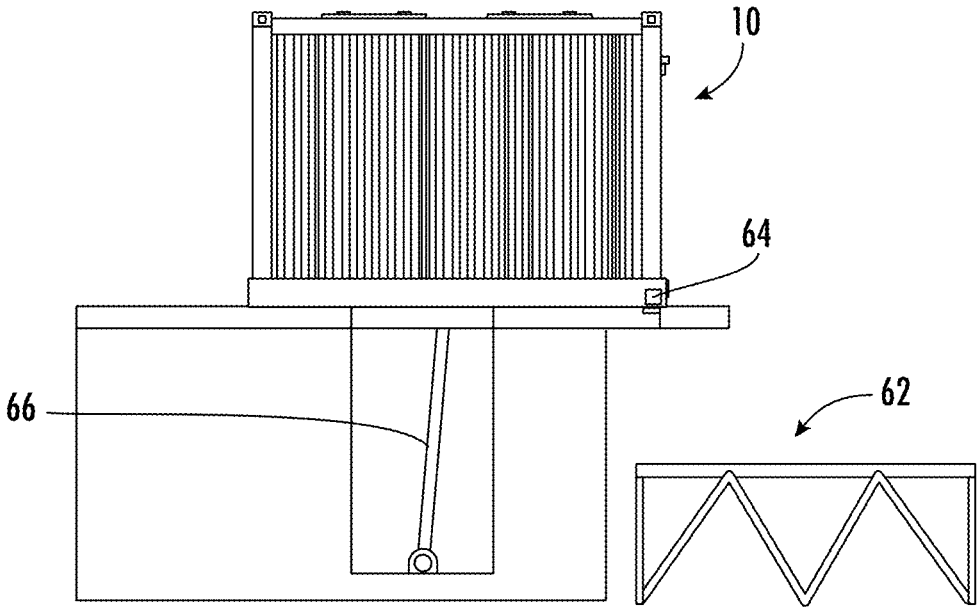
FIG. 10 is a side view of the container on the platform.
Figure 11:
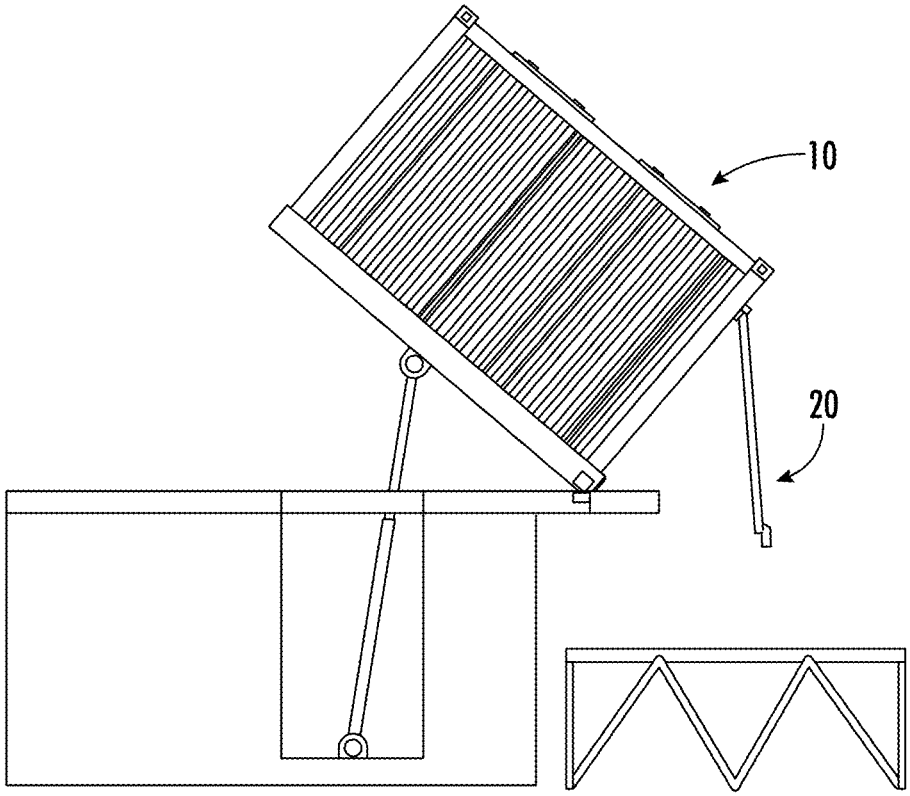
FIG. 11 is a side view illustrating the container in a tipped position.

FIG. 8 illustrates a top view of the container platform (60) and conveyer (62). The platform is 8 foot wide and 12 foot long. FIG. 9 is a side view thereof illustrating the platform (60) and conveyer (62). The platform (60) having a pivot point (64). The platform can be lifted by the hydraulic actuator (66). As illustrated in FIG. 10, the container (10) is coupled to the platform (60) in preparation of dumping the contents of the container onto the conveyor (62). Depicted in FIG. 11, a side view illustrates the container (10) in a tipped position by extension of the hydraulic actuator (66) while the rear door (20) is unlocked. The rear door opening to expel product from the container.

The configuration enables the following process to be used to efficiently transport the raw sugar or agricultural products without contamination from the farm to the processing facility. The following process would be followed:

1) Load Containers—The empty 8'×8'×12' containers will be loaded at the farm and the openings secured to protect the contents.
2) Transport Containers—The full containers will be placed on truck bogie and transported to a rail car.
3) Load Rail Car-Using standard container handling gear, the full containers are removed from the truck bogie and placed on a standard Trailer on Flatcar (TOFC) rail car four to a car.
4) Transport Unit Train—The number of containers and rail cars will be established based on the particulars of the farm/processing facility to optimize processing plant efficiency, amount of rail car/containers used and seasonal production/sale of agricultural products. It is envisioned that the scale/volume of containers will be such that unit trains can be used for efficient round-trip deployment. The full containers are delivered to rail facility nearby agricultural processing facility.
5) Offload Rail Car—Using standard container handling gear, the full container(s) are removed from the rail car and placed on standard truck bogie.
6) Transport Containers—The truck bogies will transport the full containers to the processing facility offloading station.
7) Offload Container—The full container will be offloaded from the truck bogie and placed in a rotate to dump discharging station. After dumping, the container openings will be resealed to prevent entry of moisture or contaminants.
8) Transport Container—The empty container will be backloaded on the truck bogie and transported back to the rail facility for placement on empty rail car.
9) Load Rail Car—Using standard container handling gear, the empty containers are removed from the truck bogie and placed on a standard TOFC rail car four to a car.
10) Transport Unit Train—Return empty unit train to farm rail facility.
11) Offload Rail Car—Using standard container handling gear, the empty containers are removed from the rail car and placed on standard truck bogie.
12) Transport Containers—The truck bogies will transport the empty containers to the farm loading station. Repeat steps 1-12 as scale/volume of cargo require.

The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a method or device that "comprises," "has," "includes" or "contains" one or more steps or elements, possesses those one or more steps or elements, but is not limited to possessing only one or more elements. Likewise, an element of a device that "comprises," "has," "includes" or "contains" one or more features, possesses those one or more features, but is not limited to possessing only those one or more features. Furthermore, a device or structure that is configured in a certain way is configured in at least that way, but may also be configured in ways that are not listed.

One skilled in the art will readily appreciate that the present invention is well adapted to carry out the objectives and obtain the ends and advantages mentioned, as well as those inherent therein. The embodiments described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims.

What is claimed is:

1. A method of transporting raw sugar from a production site to a processing facility, the method comprising:

loading raw sugar at the production site into a modular container defined as a generally rectangular, box-shaped enclosure formed from opposing side walls, a front wall, a rear wall, a bottom wall, and a top wall; a discharge door formed in the rear wall and hinged along an upper edge thereof to pivot outwardly between a closed position and an open position, the discharge door including a perimeter sealing gasket and a discharge door locking latch configured to maintain a water-tight seal in the closed position; at least one water-tight access door formed in the top wall, said access door being hingedly coupled to the top wall to pivot upwardly to an open position and including a sealing gasket and at least one access door locking latch configured to maintain a water-tight seal when said access door is in a closed position; and a corner lifting fixture positioned at each of the upper corners of the enclosure, the corner lifting fixtures being structurally reinforced and configured to engage standardized intermodal lifting equipment for lifting, stacking, and transport of the container;

sealing said access doors of the modular container to protect the raw sugar from moisture and contamination;

securing the sealed modular container to a transport mode by engaging said corner lifting fixtures, said transport mode selected from the group consisting of a truck bogie and a rail car;

transporting the modular container to a destination refinery discharge station at the processing facility;

releasing said discharge door locking latch;

tipping said modular container with a hydraulic actuator wherein the raw sugar is expelled through the discharge door; and resealing the modular container to prevent entry of moisture or contaminants and returning the modular container to the production site.

2. The method of transporting raw sugar from a production site to a processing facility according to claim 1, including a second access door, wherein each of said first access door and said second access door includes a moisture barrier to prevent ingress of humidity during transport.

3. The method of transporting raw sugar from a production site to a processing facility according to claim 1, including container inner walls, wherein the container inner walls are coated with high-density polyethylene (HDPE).

4. The method of transporting raw sugar from a production site to a processing facility according to claim 1, wherein the discharge door pivots upwardly and is constructed and arranged to provide an unobstructed discharge opening extending substantially across the rear wall.

5. The method of transporting raw sugar from a production site to a processing facility according to claim 1, wherein the hydraulic actuator tips the modular container about a horizontal axis.

6. The method of transporting raw sugar from a production site to a processing facility according to claim 1, wherein the corner lifting fixtures comprise standardized intermodal lifting fixtures compatible with spreader lifting frames.

7. The method of transporting raw sugar from a production site to a processing facility according to claim 1, wherein the box-shaped enclosure has a width of 8 feet, a height of 8 feet, and a length of 12 feet.

* * * * *